US006775910B1

(12) United States Patent
Coffey

(10) Patent No.: US 6,775,910 B1
(45) Date of Patent: Aug. 17, 2004

(54) SEGMENTED CORE

(75) Inventor: James B. Coffey, Vandalia, OH (US)

(73) Assignee: NCR Corporation, Dayton, OH (US)

( * ) Notice: Subject to any disclaimer, the term of this patent is extended or adjusted under 35 U.S.C. 154(b) by 1005 days.

(21) Appl. No.: 09/085,933

(22) Filed: May 28, 1998

(51) Int. Cl.[7] ..... B26D 5/00

(52) U.S. Cl. ..... 29/895.211; 29/895.22; 492/38

(58) Field of Search ..... 492/38, 33, 22, 492/39; 29/895.211, 895.3, 412, 415, 417, 895.21, 895.22; 83/425.3, 431, 649, 856, 858

(56) References Cited

U.S. PATENT DOCUMENTS 176,171 A * 4/1876 Dow ..... 139/296
2,710,060 A * 6/1955 Birkmann ..... 83/649
3,657,779 A * 4/1972 Granberry ..... 198/842
3,803,959 A * 4/1974 Rung ..... 83/18
3,835,615 A * 9/1974 King, Jr. ..... 403/408.1
4,107,827 A * 8/1978 Sasshofer et al. ..... 28/246
4,192,050 A * 3/1980 Appenzeller ..... 29/895.211
4,730,510 A * 3/1988 Graham ..... 74/502
5,221,267 A * 6/1993 Folden ..... 604/200
5,421,259 A * 6/1995 Shiba et al. ..... 101/232
5,431,191 A * 7/1995 Neuhauser et al. ..... 138/137
5,477,912 A * 12/1995 Cisko et al. ..... 164/481
6,042,525 A * 3/2000 Rajaniemi ..... 492/39

* cited by examiner

*Primary Examiner*—Peter Vo
(74) *Attorney, Agent, or Firm*—Francis L. Conte, Esq.

(57) ABSTRACT

A segmented core includes a plurality of integral core segments defined by a respective separation slot in the outer surface thereof. A sheet is wound around the core in a plurality of layers and is slit at the slot to simultaneously wind respective sheet ribbons on the core segments to form individual rolls. The sheet slit is aligned with the core slot which allows the wound rolls to be broken apart at the slots.

20 Claims, 4 Drawing Sheets

SEGMENTED CORE

BACKGROUND OF THE INVENTION

The present invention relates generally to wound sheet rolls, and, more specifically, to the manufacture thereof.

Sheet rolls are found in various forms including paper rolls used in adding machines, cash registers, Automated Teller Machines (ATMs), and fax machines for example. Each roll includes a sheet of paper wound around a center core. The core may be formed of paper, or plastic in a solid or honeycomb configuration.

Plastic cores are typically manufactured by extrusion, or may be individually molded. In extrusion production, tubular cores are extruded in logs of two or more unit cores and then precut to desired unit lengths. The logs are accumulated in batches and simultaneously cut into the unit cores using a gang saw. The length of the individual cores is therefore controlled by the accuracy of sawing the opposite ends thereof from the logs.

Each core must meet a suitable tolerance specification in length and diameter, for both the subsequent winding of paper thereon and use thereof in the appropriate machine for which it is produced. In order to wrap each core with paper, several cores, between thirty and forty for example, are coaxially mounted in end-to-end contact on a common mandrel or arbor in the form of a rod which extends through the bores thereof. The number of cores is determined by their individual length so that they may collectively extend within the full width of the corresponding supply paper roll. The paper is carried through a slitting and winding machine which simultaneously slits the paper into a number of ribbons corresponding to the number of cores for winding the ribbons on the individual cores on the run.

The slitting machine includes a plurality of female slitting knives in disk form which are axially aligned with the abutting ends of adjacent cores on the mandrel to effect respective parting planes between the opposite axial ends of each of the cores once they are wound with the paper. The knives are typically mounted on a common support, and are accurately spaced apart from each other using precision spacers. The wound paper rolls are then removed from the mandrel and separated, and typically undergo a pressing operation on each of the opposite two axial sides to ensure suitable flushness of the paper edges and the central core. The individual paper rolls may then be formed in suitable groups or packs and are typically wrapped in shrinkwrap plastic for subsequent delivery to the marketplace.

This method of production has been in commercial use for many years for producing large batches of paper rolls at significant speed. However, very small tolerances are required in manufacturing the individual cores and aligning them in the slitting machine to reduce undesirable manufacturing problems. Typical manufacturing tolerances are represented by plus and minus values which necessarily result in stack-up of the different tolerances where tolerances may accumulate and exacerbate alignment problems.

One common problem is the inter-leaving of adjacent sheet ribbons during the winding process which physically joins together adjacent wound rolls. This sometimes makes difficult, if not impossible, the breaking apart of the adjacent paper rolls upon removal from the mandrel. Similarly, individual cores may protrude from one end of the respective paper rolls and into an opposite end of an adjacent paper roll on the mandrel which also makes difficult the separation of the individual rolls upon removal from the mandrel. Core protrusion also increases the need for post-processing of the paper rolls to drive flush the core ends with the paper ends.

Yet another problem may occur at the beginning of the slitter winding process when the leading edge of the paper is bent 180° in a tuck prior to being wound atop the core. These tucked tails are created by blowing with air the several leading edges of the ribbons for engaging a cooperating tucking bar which forms the tucked tails directly on the outer surface of the several cores. Excessive tolerance accumulation may also result in overlapping of the tucked tails which again renders difficult the separation of the final paper rolls from the mandrel after the winding process.

The very nature of the prior art gang sawing of unit cores from the core logs necessarily results in a corresponding tolerance in the length of the individual cores which is related to the initial length of the logs. A typical minimum tolerance in core length is about plus or minus 5 mils and increases as the log length increases. This is in contrast with the spacing tolerance between adjacent slitting knives which may be as little as about plus or minus 1.5 mils in view of the precision spacers used in mounting together the slitting knives.

Since the individual cores are merely arranged in abutting end-to-end contact on the cooperating common mandrel, the tolerances of each of the cores accumulates over the total number of cores mounted on an individual mandrel. Due to the random nature of manufacturing tolerances and accumulation thereof, excessive tolerance accumulation resulting in misalignment between the slitting knives and the core intersections can result, which occasionally leads to the undesirable problems mentioned above.

Accordingly, it is desired to eliminate or reduce excessive tolerance accumulation in the production of sheet wound cores for improving the manufacture thereof.

SUMMARY OF THE INVENTION

A segmented core includes a plurality of integral core segments defined by a respective separation slot in the outer surface thereof. A sheet is wound around the core in a plurality of layers and is slit at the slot to simultaneously wind respective sheet ribbons on the core segments to form individual rolls. The sheet slit is aligned with the core slot which allows the wound rolls to be broken apart at the slots.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
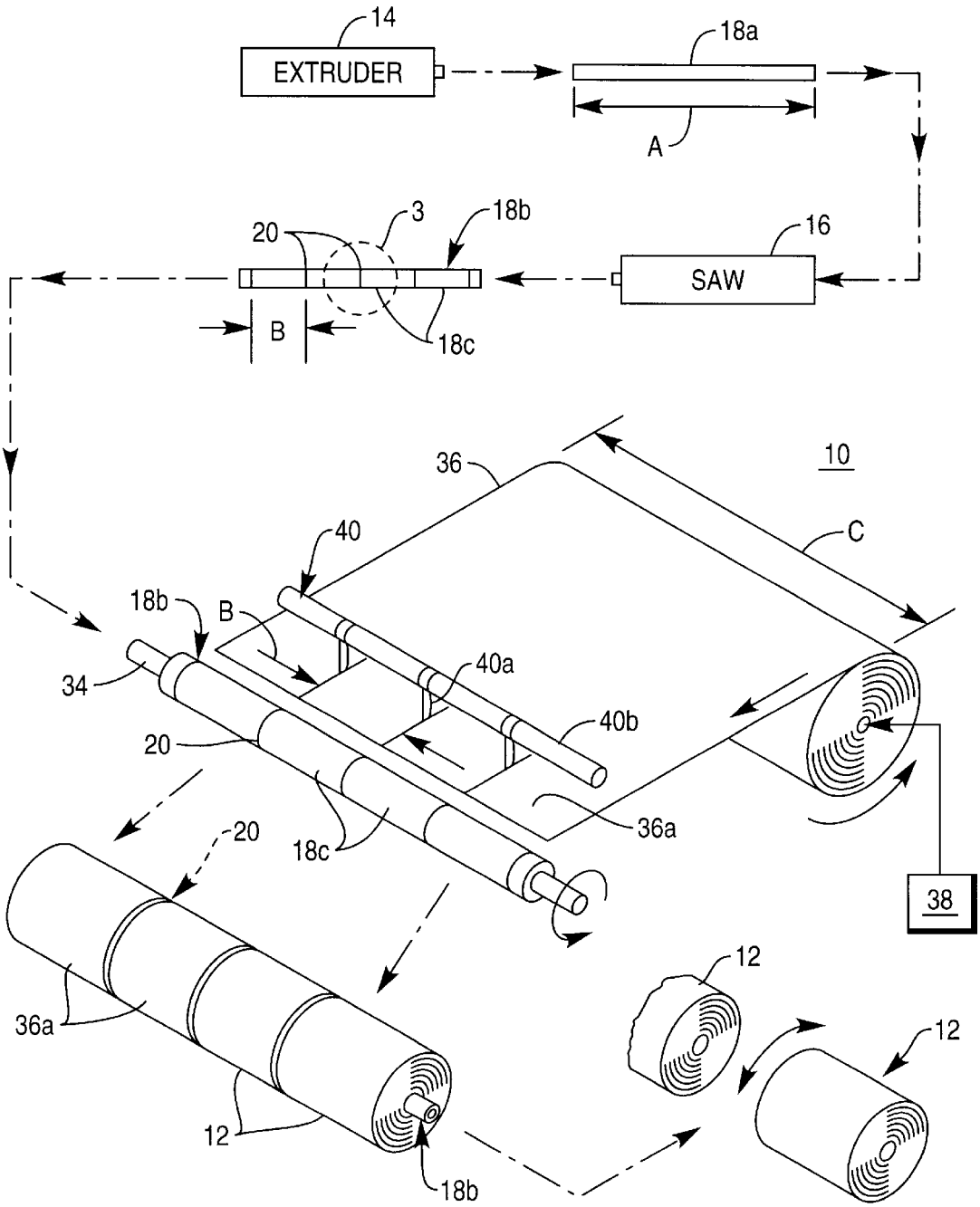
FIG. 1 is a schematic representation of an apparatus for producing segmented cores and winding the cores with a sheet in accordance with an exemplary embodiment of the present invention.
Figure 2:
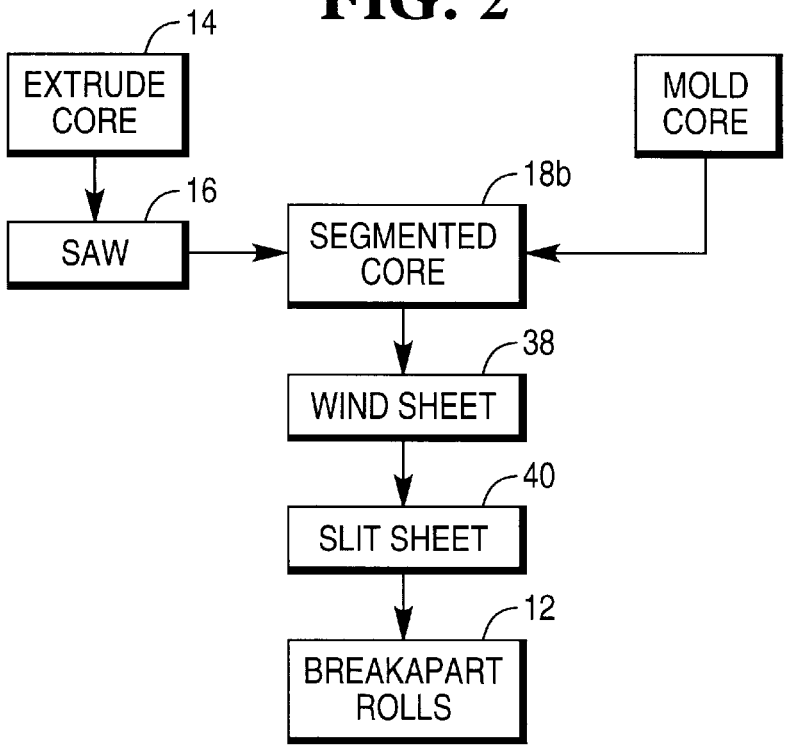
FIG. 2 is a flowchart representation of an exemplary method of producing sheet wound segmented cores corresponding with the apparatus illustrated in FIG. 1.

Illustrated in FIG. 1 is an apparatus 10 for making wound rolls 12 in accordance with an exemplary embodiment of the present invention. FIG. 2 is a flowchart representation of an exemplary method for making the rolls 12 using the exemplary apparatus illustrated in FIG. 1.

Means in the exemplary form of a conventional extruder 14 and conventional saw 16 are provided for producing a segmented core 18*b* from an initial, uninterrupted core 18*a* in log form. In a typical application, the cores are formed of a suitable plastic which is initially melted in the extruder 14 and forced through a die to produce a continuous and uniform, axially elongate log core 18*a* which is suitably cut to a desired total length A. This process is conventional like that described in the background section, but instead of grouping the individual logs for gang sawing into individual unit cores, the individual logs remain full length through the winding process prior to being separated into individual segments.

The saw 16 is used in accordance with the present invention for forming an annular interruption or separation slot 20 around the circumference of the core 18*b* to divide the core into a suitable number of integral core units or segments 18*c*. In the exemplary embodiment illustrated in FIG. 1 five slots 20 are formed in the core 18*b* to define a unicore having four core segments 18*c* of equal length B, with two short opposite ends which may be subsequently removed as scrap for protecting the core ends during the manufacturing process.

Figure 3:
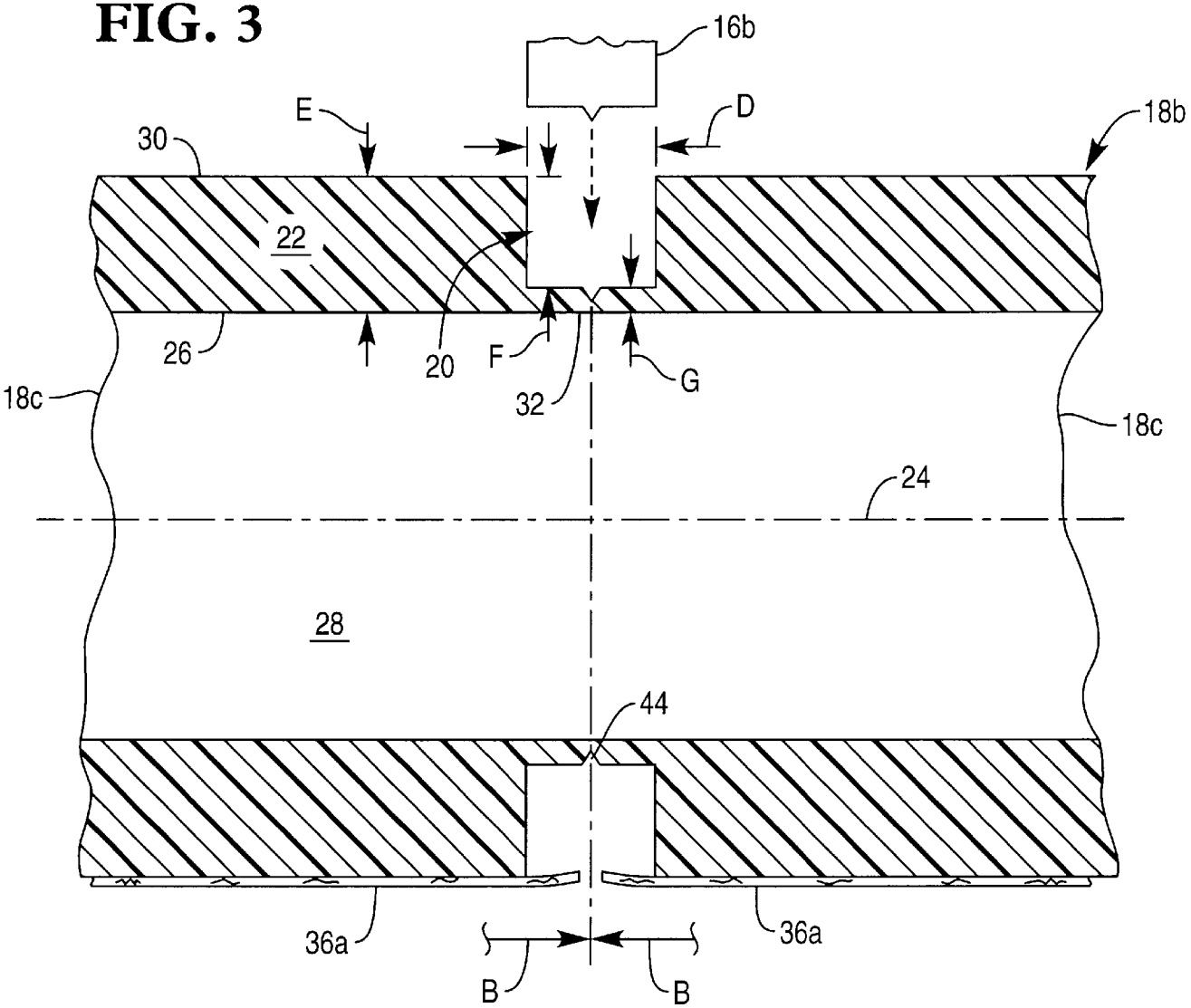
FIG. 3 is an enlarged, elevational sectional view through adjacent core segments at a joining slot in the segmented core illustrated in FIG. 1 in the dashed circle labeled 3.

FIG. 3 is an enlarged view of one of the slots 20 in an exemplary form. The segmented core 18*b* is in the preferred form of a solid-wall plastic tube, although in alternate embodiments it may be formed of any suitable material including paper, for example, and may also be honeycomb in wall section instead of solid if desired.

In this exemplary embodiment, the core 18*b* is in the form of a solid tubular wall 22 disposed coaxially about a longitudinal or axial centerline axis 24. The wall 22 has an axially continuous, annular inner surface 26 which defines an empty cylindrical bore 28. The wall 22 includes a coaxial annular outer surface 30 which is preferably imperforate except for being axially interrupted by the coaxial annular slot 20. The slot 20 extends preferably only in part-depth radially inwardly through the wall 22 and terminates at an integral annular web 32.

In the exemplary embodiment illustrated in FIGS. 1 and 3, each of the core segments 18*c* is defined between a respective pair of the slots 20. In one simple form, the slot 20 has a sharp cornered rectangular configuration formed by a complementary shaped saw blade 16*b*. The blade 16*b* may be suitably rotated around the stationary initial core 18*a* to form the respective slot 20 therein, or the blade 16*b* may be stationary and the core 18*a* suitably rotated. Although an exemplary saw 16 is illustrated, any suitable apparatus for forming the slots 20 around the circumference or outer surface 30 of the core 18*a* in part-depth therethrough may be used. For example, lathes, grinders, lasers, or knives in various forms may be used to form the slots 20.

In yet another embodiment, the segmented core 18*b* may be individually molded in any conventional manner.

The individual segmented core 18*b* in whatever manner formed may then be mounted on a suitable mandrel 34 in an otherwise conventional slitting and winding apparatus, shown schematically in part. Instead of mounting a plurality of independent and discrete unit cores end-to-end on the mandrel 34 as was done in the prior art, the unitary segmented core 18*b* is instead mounted on the mandrel 34. The individual webs 32 illustrated in FIG. 3 provide a physical interconnection between the several core segments 18*c* maintaining them in accurate alignment with each other and necessarily eliminating both the manufacturing length tolerance on the individual core segments 18*c* since they are not fully cut through, and the associated stack-up manufacturing tolerances attributable to end-to-end stacking of the prior art unit cores. Although the several saw blades 16*b* have an associated center-to-center position tolerance, the saw blades do not completely cut apart the individual core segment 18*c* maintaining an axially continuous inner surface 26 not subject to axial stack-up tolerance accumulation.

As illustrated in FIG. 1, the segmented core 18*b* is suitably mounted in the travel path of a continuous sheet 36 of paper, plastic, or any desired material which is initially provided in a large roll having a continuous width C. The number of core segments 18*c* is chosen to provide full axial coverage thereof from the single width sheet 36.

Means in the form of a conventional winding apparatus 38 are provided in cooperation with the mandrel 34 and segmented core 18*b* for winding the common sheet 36 around the segmented core in a plurality of spiraling layers until the desired quantity of sheet material is formed on the several core segments 18*c*. Cooperating with the winder 38 are means 40 for slitting the sheet 36 at each of the slots 20 during the winding step to simultaneously wind respective sheet ribbons or segments 36*a* on the respective core segments 18*c* to simultaneously form the separate wound rolls 12.

Figure 4:
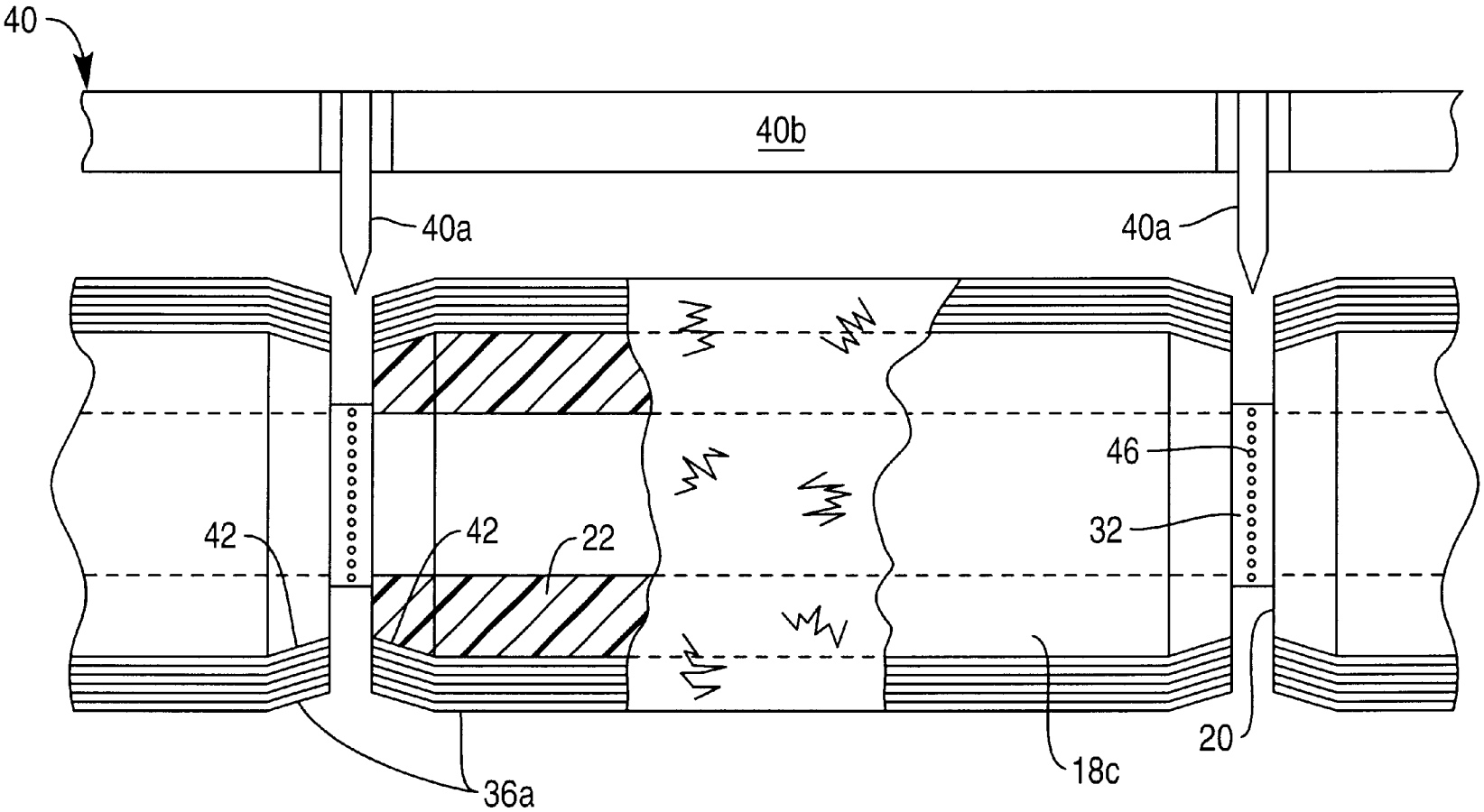
FIG. 4 is a partly sectional, elevational view of a core log having crowned core segments in accordance with another embodiment of the present invention.

The slitter 40 may take any conventional form such as that described in the background section, and includes a plurality of female slitting knives 40*a* aligned with respective slots 20 for self-centering the ribbons on the respective core segments during the winding process. As shown in FIGS. 1 and 4, the individual female slitting knives 40*a* may be mounted on a common support bar 40*b* which positions the knives in the travel path of the sheet 36 for cutting or slitting the sheet to form the separate ribbons 36*a* which are simultaneously wound around the respective core segments 18*c*. The individual knives 40*a* are accurately mounted on the support bar 40*b* with a center-to-center tolerance which is extremely small and on the order of about plus or minus 1.5 mils, for example.

Since the individual slots 20 may be accurately formed in the segmented core 18*b* with individual lengths B, the corresponding spacing of the knives 40*a* is accurately maintained for slitting the sheet 36 into corresponding ribbons 36*a* with a width (B) which is the same as the length B of the individual core segments 18*c*. The slitting knives 40*a* are preferably axially aligned with respective ones of the slots 20 for self-centering the individual ribbons 36*a* on their respective core segments 18*c* during the winding process.

As indicated above, a significant advantage of the present invention is the elimination of the accumulation or stack-up of manufacturing tolerances in length of the prior art unit cores by using the segmented, but continuous core 18*b* aligned with the knives 40*a*. This ensures an improved location of the respective paper slits directly over corresponding ones of the slots 20 as illustrated in FIG. 3. Each slot 20 has a width D which is preferably relatively narrow and may be about 60 mils for example. The edges of the ribbons 36*a* are therefore unsupported over the respective slots 20 which, in practice, allows the individual core segments 18*c* to have a crowning effect, with the edges of the ribbons 36*a* curling slightly radially inwardly for self-centering the ribbons during the winding process. The slight curling of the ribbon edges also increases the spacing therebetween reducing the likelihood of interleaving of the adjacent ribbons during the winding process.

The length B of the individual core segments 18*c* is preferably measured center-to-center between corresponding pairs of the slots 20. Correspondingly, the width of the individual ribbons 36*a* is preferably equal to the length B of the core segments. In this way, the opposite edges of each ribbon 36*a* necessarily extend into at least one of the underlying slots 20 and tend to curl therein during the winding process. As indicated above, this has the practical effect of crowning the core segments 18*c* at the respective slots 20 for self-centering the ribbons 36*a* on the respective core segments 18*c*.

FIG. 4 shows an alternate embodiment of the present invention wherein each core segment 18*c* is modified so that the tubular wall 22 includes slightly tapered chamfers 42 at the respective slots 20 to provide a pronounced crown in each of the core segments 18*c* for improving self-centering of the ribbons 36*a* being wound therearound.

Upon completion of the winding and slitting process illustrated in FIG. 1, the several core segments 18*c* have wound thereon a suitable length of the individual ribbons 36*a*. The wound segmented core 18*b* is then removed from the mandrel 34 and remains a unitary log member, with the individual wound rolls 12 remaining joined together through the interconnecting webs 32 shown in FIG. 3. This log of paper roll may itself be suitably packaged and distributed into the market, or may be broken into each individual rolls 12 and repackaged in various configurations as desired.

Accordingly, the improved segmented core 18*b* defines an improved product which allows the breaking apart of the wound rolls 12 at the respective core slots 20 to detach or separate the individual core segments 18*c* and ribbons thereon in the form of the unitary wound rolls 12. This may be accomplished either automatically in a suitable machine configured therefor, or manually by simply twisting or bending each segmented core 18*b* to develop sufficient force for shearing the individual webs 32 and separating the segments thereat.

The slot 20 illustrated in FIG. 3 may have any suitable form such as the rectangular, U-shaped slot illustrated, or a sharper V-shape, or others as desired. The slot 20 provides a convenient location at which the core segments 18*c* may be broken apart, yet the connecting web 32 ensures a rigid connection of the individual segments 18*c* until separation thereof is desired. The core wall 22 has a thickness E, and the slot 20 has a depth F which is suitably less than the wall thickness E for maintaining a rigid assembly, yet allowing breaking apart when intended. The web 32 has a thickness G which is thinner than the slot 20 is deep, and may be less than about 10 mils, for example, for conventional plastic core material.

In the preferred embodiment illustrated in FIG. 3, means in the exemplary form of a score cut 44 are formed in the outer surface of the web 32 for locally weakening the web 32 at the bottom of the slot 20 to define a break-apart plane equidistantly between the core segments. The score 44 may be formed separately or simultaneously using the common saw blade 16*b* specifically configured therefor. Or, the score 44 may made in another operation using a suitable tool therefor. The score 44 further reduces the thickness of the web 32 at its axial center plane so that stress is concentrated thereat when bending or twisting force is applied to the segmented core 18*b* for separating the individual core segments 18*c* by shear force.

FIG. 4 illustrates an alternate embodiment wherein a plurality of circumferentially spaced apart perforations 46 are suitably formed, by drilling for example, through the center plane of the web 32 to locally weaken the web for concentrating stress thereat for improving the ease of breaking apart the individual core segments 18*c* under applied bending or twisting force.

The segmented core 18*b* described above provides substantial advantages over using individual prior art core segments suitably stacked together in the slitting and winding apparatus. As an integrated one-piece unicore member, the segmented core 18*b* is more readily assembled over the mandrel 34 and into the slitting and winding apparatus in a simpler operation. Corresponding stack-up tolerance accumulation is necessarily eliminated since the core segments 18*c* are not separated until after the winding process. Since the slots 20 provide unsupported regions for the sheet ribbons 36*a* during the winding process, they allow a slight increase in separation of the slit ribbon edges for reducing the likelihood of interleaving during the winding process.

Figure 5:
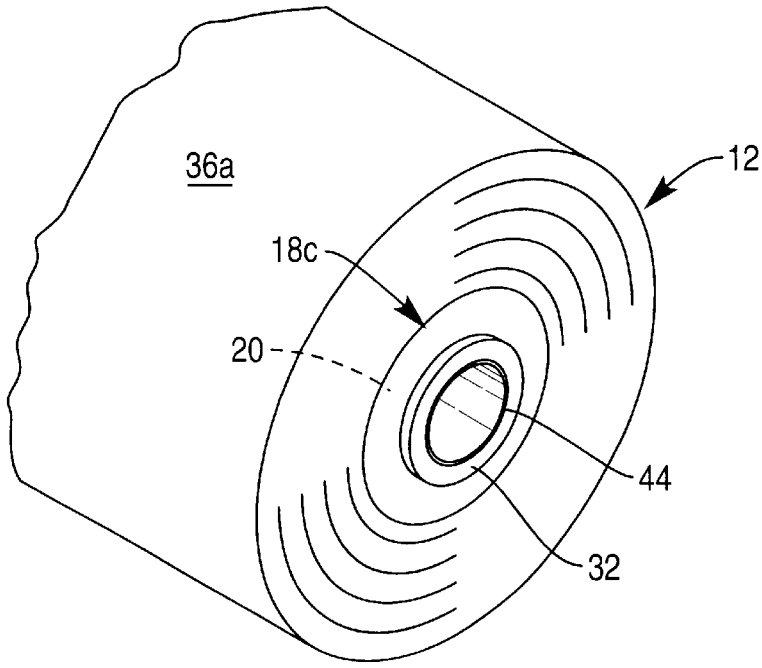
FIG. 5 is an isometric view of a wound roll formed by the apparatus illustrated in FIG. 1 and separated from the remainder of the core log.

FIG. 5 illustrates an end view of an exemplary one of the rolls 12 after being broken away from adjacent segments of the core log. The core segment 18*c* retains a half-portion of the slot 20 which forms a recess into the end face of the wound ribbon 36*a*. A half-portion of the web 32 also remains and terminates at the score 44 at which separation from the adjacent core segment 18*c* has occurred. This configuration reduces the likelihood of core protrusion from an end face of the roll 12. If desired, the rolls 12 may still undergo the conventional post-processing flattening press operation to more accurately align flush the ends of the wound ribbons 36*a* with the remaining web 32.

Since the integrated segmented core 18*b* maintains accurate positioning of the individual core segments during the winding process, the likelihood of overlapping of tucked tails of the ribbon leading edge is also reduced. Paper rolls with or without tucks may be produced under the present invention with improved efficiency as compared with the prior art. And, the improved segmented core 18*b* may be used with otherwise conventional paper roll forming equipment including the slitting and winding apparatus since the segmented core provides a corresponding alternative to discrete unitary cores requiring fixturing to maintain them in abutting contact in the equipment.

And, wound core logs provide an alternate product which may be distributed to end users for individual separation of the wound core segments when desired. Alternatively, the individual log may be broken apart and reconfigured in various packs in any conventional manner. Individual paper rolls or packs thereof are typically further wrapped in shrinkwrap for distribution to end users. The wound log of the present invention may be correspondingly shrink wrapped, with suitable perforations formed in the shrinkwrap corresponding with the axial locations of the slots 20 so that the individual rolls may be broken apart from the log with the shrinkwrap remaining attached.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A method for making wound rolls comprising:

producing a segmented core having a tubular wall including an inner surface defining a bore, and an outer surface interrupted axially by an annular slot extending radially inwardly to an integral web for defining a plurality of core segments;

winding a sheet around said core in a plurality of layers; and slitting said sheet at said slot during said winding step to simultaneously wind respective sheet ribbons on said core segments to form said rolls.

2. A method according to claim 1 further comprising aligning said sheet slitting with said slot for self-centering said ribbons on said respective core segments.

3. A method according to claim 2 further comprising breaking apart said wound rolls at said slot.

4. A method according to claim 2 wherein said segmented core producing step comprises:

extruding a uniform core; and forming said slot around an outer surface of said uniform core in part-depth therethrough to axially segment said uniform core.

5. A method according to claim 2 further comprising locally weakening a remaining core web at a bottom of said slot to define a break-apart plane between said core segments.

6. A method according to claim 5 wherein said core web is scored to define said break-apart plane.

7. A method according to claim 5 wherein said core web is perforated to define said break-apart plane.

8. A method according to claim 2 further comprising crowning said core segments at said slot for self-centering said ribbons on said core segments.

9. An apparatus for making wound rolls comprising:

means for producing a segmented core having a tubular wall including an inner surface defining a bore, and an outer surface interrupted axially by an annular slot extending radially inwardly to an integral web for defining a plurality of core segments;

means for winding a sheet around said core in a plurality of layers; and means for slitting said sheet at said slot during winding to simultaneously wind respective sheet ribbons on said core segments to form said rolls.

10. An apparatus according to claim 9 wherein said slitting means include a knife aligned with said slot for self-centering said ribbons on said respective core segments.

11. An apparatus according to claim 10 wherein said segmented core producing means comprise:

an extruder for extruding a uniform core; and a saw for forming said slot around an outer surface of said uniform core in part-depth therethrough to axially segment said uniform core.

12. A core for winding a slit sheet therearound comprising a solid tubular wall having an inner surface defining a bore, and an outer surface interrupted axially by a plurality of annular separation slots extending radially inwardly to an integral web for defining a plurality of equal-length core segments bounded by shorter scrap end segments breakable apart at said slots.

13. A core according to claim 12 wherein said web is thinner than said slot is deep.

14. A core comprising:

a tubular wall having an inner surface defining a bore, and an outer surface interrupted axially by an annular slot extending radially inwardly to an integral web for defining a plurality of core segments; and means for locally weakening said core web to define a break-apart plane between said core segments.

15. A core according to claim 14 wherein said weakening means include a score in said web.

16. A core according to claim 14 wherein said weakening means include a plurality of perforations.

17. A core comprising:

a tubular wall having an inner surface defining a bore, and an outer surface interrupted axially by an annular slot extending radially inwardly to an integral web for defining a plurality of core segments; and wherein said wall includes chamfers at said slot to crown said core segment for self-centering sheet ribbons wound therearound.

18. A core comprising:

a tubular wall having an inner surface defining a bore, and an outer surface interrupted axially by an annular slot extending radially inwardly to an integral web for defining a plurality of core segments; and a slit sheet wound around said core segments in a plurality of corresponding sheet ribbons thereon defining a wound roll log.

19. A core according to claim 18 wherein said core has a continuous inner surface axially along said core segments and an axially segmented outer surface therealong.

20. A core according to claim 19 wherein said ribbons axially adjoin each other at corresponding crowns.

* * * * *